United States Patent [19]

Merriman

[11] Patent Number: 4,570,275

[45] Date of Patent: Feb. 18, 1986

[54] BEDDING SUPPORT

[76] Inventor: Henry H. Merriman, Apt. C101, 3400 Carpenter Rd., Ypsilanti, Mich. 48197

[21] Appl. No.: 661,729

[22] Filed: Oct. 17, 1984

[51] Int. Cl.[4] ..... A47C 21/02

[52] U.S. Cl. ..... 5/505; 5/429; 248/175; 403/104; 403/300

[58] Field of Search ..... 5/505, 506, 504, 429; 248/175, 172; 403/104, 300

[56] References Cited

U.S. PATENT DOCUMENTS

| | | | |
|---|---|---|---|
| 1,422,744 | 7/1922 | Cortese | 5/505 |
| 1,577,089 | 3/1926 | Whitford | 5/505 |
| 2,106,834 | 2/1938 | Ewald | 5/505 |
| 2,602,171 | 7/1952 | Good | 5/505 |
| 2,618,789 | 11/1952 | Kane | 5/505 |
| 2,668,963 | 2/1954 | Drake | 5/505 |
| 2.772,063 | 11/1956 | Remstein | 248/172 |
| 2,878,492 | 3/1959 | Emery | 5/505 |
| 3,317,932 | 5/1967 | Gibbons | 5/505 |

*Primary Examiner*—Alexander Grosz
*Attorney, Agent, or Firm*—Beaman & Beaman

[57] ABSTRACT

The invention pertains to bedding support apparatus for supporting bed clothes above the mattress to alleviate the weight of bed clothes upon a patient. Rigid frame elements inserted under the mattress include a wire core encased in a cylindrical synthetic plastic cover. The bedding support consists of two frame elements each having coaxially aligned end portions bridged by a tubular connector into which the end sections are telescoped. Depressions are formed in the connectors extending into the connector bore whereby frictional engagement is made with the element cover permitting the width of the bedding support to be readily adjusted, and the depressions insuring frictional contact between the frame elements and tube connectors regardless of variable dimensional tolerances.

3 Claims, 5 Drawing Figures

BEDDING SUPPORT

BACKGROUND OF THE INVENTION

Bedding supports are used to support portions of bed clothes preventing the weight thereof to bear upon the patient and cause discomfort. For instance, bedding supports are employed at the foot of a mattress to relieve the weight of the bed clothes upon the sleeper's feet, and supports are often used at the lateral portions of beds to relieve bed clothing weight at the upper body regions, such as often required with burn patients.

A variety of bed clothing supports have been proposed. Typical examples are shown in U.S. Pat. Nos. 1,577,089; 2,106,834; 2,602,171 and 2,618,789.

Prior bedding support devices have not met extensive acceptance for a variety of reasons, and it is an object of the invention to provide a bedding support which overcomes the deficiencies of the prior art devices.

An object of the invention is to provide a bedding support for use with a mattress wherein the mattress maintains the support in its operative condition, and wherein the width of the support may be readily adjusted by unskilled operators.

A further object of the invention is to provide a mattress oriented bedding support which is of economical construction, of light weight and high strength, adjustable in dimension, and readily maintainable in a sanitary condition.

Yet another object of the invention is to provide a bedding support utilizing frame elements formed of metal rod encased within a cylindrical synthetic plastic cover, the elements of the bedding support being interconnected by synthetic plastic tubular connectors utilizing friction producing depressions engagable with the frame element to compensate for dimensional variations and insuring a firm frictional telescoping interconnection between the frame elements and connector to facilitate adjustment.

In the practice of the invention a pair of frame elements are maintained in adjusted assembled relationship by a pair of tubular connectors. The frame elements are formed by metal rod of the desired configuration, and the rod is encased within a synthetic plastic cover having a cylindrical configuration. The frame elements include linear upper and and lower sections which are, respectively, axially aligned and interconnected by synthetic plastic tubular connectors telescopingly receiving an end section.

The connectors employ depressions defined by a deformation of the connector material wherein the depressions extend into the bore of the connector for engagement with the frame element section cover insuring an effective frictional relationship therewith regardless of the dimensional tolerances existing between the frame element cover and the tubular connector.

By encasing the metal core of the frame elements within synthetic plastic, and utilizing a synthetic plastic connector between the frame elements, the bed support can be readily maintained in a sanitary condition as required in hospital usage. As the depressions defined in the connectors permit a frictional telescoping interrelationship between the associated connector and frame element end sections, dimensional variations that exist in the diameter of the frame section cover do not adversely affect the effectiveness of the connector to maintain the adjusted bed support width, and adjustments may be readily made by unskilled personnel.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

A bedding support in accord with the invention consists of four components, two frame elements 10 and 12 which are the mirror image of each other, and two identical tubular connectors 14 and 16.

Figure 1:
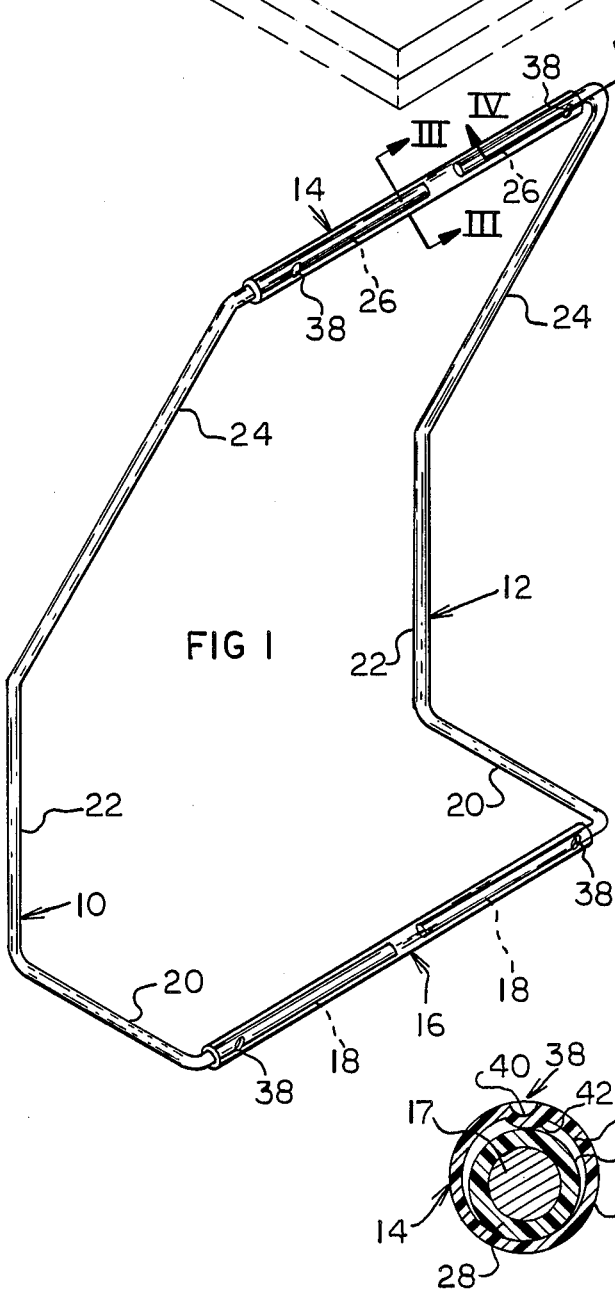
FIG. 1 is a perspective view of a bedding support in accord with the concepts of the invention.
Figure 3:
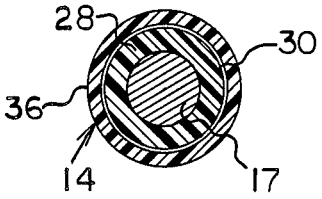
FIG. 3 is an enlarged, detail, elevational sectional view taken along Section III—III of FIG. 1.
Figure 4:
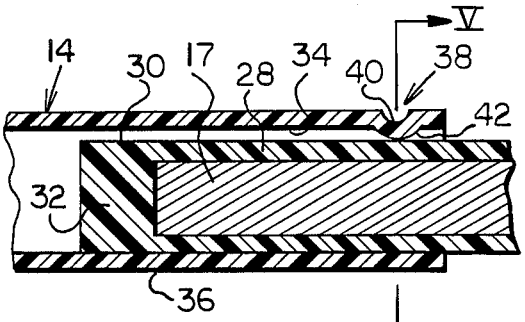
FIG. 4 is an enlarged, detail, elevational, sectional view as taken along Section IV—IV of FIG. 1.
Figure 5:
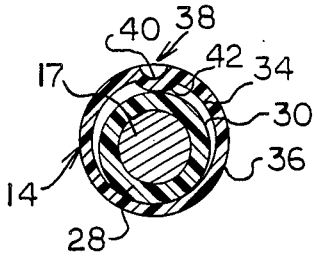
FIG. 5 is an enlarged, elevational, detail, sectional view as taken through a connector at a depression along Section V—V of FIG. 4.

The frame elements 10 and 12 are each formed of an elongated metal core, such as $\frac{1}{4}''$ steel rod 17, which is bent in the configurations readily apparent from FIG. 1. Each frame element includes a lower horizontally disposed end section 18 disposed at substantially 90° to the horizontally oriented support section 20 from which rises at 90° the vertically oriented column section 22 from which obliquely depends the mattress overlay section 24 from which depends, at 90° thereto, the horizontally disposed upper end section 26. Each frame element is preferably encased within a synthetic plastic sheath or cover 28 of approximately $\frac{1}{8}''$ thickness having an external cylindrical surface 30, which also covers the end of the rod 17 at 32.

Figure 2:
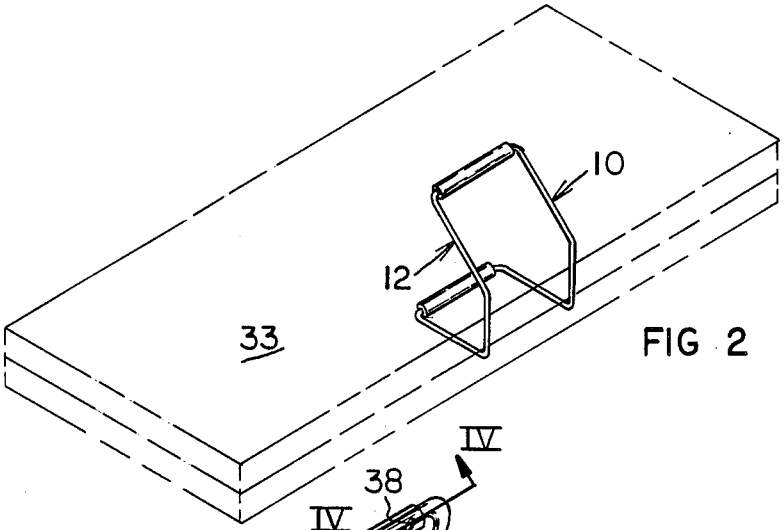
FIG. 2 is a perspective view of a mattress and bedding support in accord with the invention illustrating a typical installation, the bed clothing not being shown.

The vertical height of the column section 22 substantially corresponds to the vertical thickness of a conventional mattress 33, FIG. 2, and the dimensions of the other sections of the frame elements are discretionary, it usually being desired to support the bed clothes about 12 inches above the mattress 33.

The frame elements 10 and 12 are maintained in assembled relationship by the upper connector 14 and the lower connector 16. The connectors are identical in construction and each are formed of synthetic plastic tubing, which may be transparent, having an inner cylindrical bore 34 and an outer cylindrical surface 36. The connectors are relatively rigid, and the diameter of the bore 34 is slightly greater than the outer diameter of the plastic cover surface 30 located upon the end sections 18 and 26. Thus, the ends of the end sections 18 and 26 may be telescopingly received within the ends of the connectors 14 and 16 as appreciated from the drawings.

As it is difficult to maintain the tolerances of the diameter of the frame element's cover 28, friction producing means are interposed between the connectors and end sections, and the friction producing means comprises at least one depression formed adjacent each end of each connector wherein the material of the connector is displaced inwardly defining an outer concave surface 40, and the displaced connector material extends into the connector bore 34 at the convex surface 42. The radial extension of the surface 42 into the bore 34 is greater than the dimensional tolerances of the end section cover diameter, and accordingly, the depressions 38 will produce a frictional relationship between the connector and the associated end sections permitting the telescoping relationship for adjustment purposes, but insuring a frictional engagement which prevents inadvertent disassembly of the frame elements from the connectors.

The telescoping assembly between the frame elements and connectors permits the width of the bedding support to be readily adjusted, and in a commercial embodiment, the length of the end sections 18 and 26 is about 7 inches, while the length of the connectors is approximately 14 inches permitting an effective width adjustment of up to 8" without adversely affecting the mechanical strength of the support.

As the components of the bedding support are either formed of a synthetic plastic material, or encased in a synthetic plastic material, no metal comes in contact with the patient, and the components may be easily kept clean with soap and water, and disassembly of the components permits the interior of the connectors to be readily cleansed without affecting the efficiency of assembly.

A bedding support in accord with the aforedescribed construction may be readily packaged and shipped, requires minimal skill for assembly, and yet is capable of effectively supporting the weight of the bed clothes in that the insertion of the sections 18 and 20 under the mattress will maintain the vertical orientation of the column sections.

It is appreciated that various modifications to the inventive concepts may be apparent to those skilled in the art without departing from the spirit and scope of the invention.

I claim:

1. A bedding support for use with a bed having a mattress for supporting bedding above the mattress comprising, in combination, first and second rigid elongated configurated frame elements, said elements being a mirror image of each other and each including a horizontally disposed lower end section adjacent a horizontally disposed support section transversely oriented to the adjacent end section, a column section vertically extending from said support section having a length at least as great as the mattress thickness, a mattress overlay section extending from said column section and an upper end section transversely depending from said overlay section, said lower and upper end sections of said first and second elements, respectively, extending toward each other and in longitudinal alignment with each other, elongated tubular connectors having open ends, said aligned lower and upper end sections being slidably received within opposite ends of a connector permitting longitudinal adjustment therein, and friction producing means interposed between said connectors and the end sections received therein comprising inwardly extending elements defined upon said connectors frictionally engaging the associated frame element end sections.

2. In a bedding support as in claim 1, said frame elements having a rigid metal core and a synthetic plastic coating surrounding said core.

3. A bedding support for use with a bed having a mattress for supporting bedding above the mattress comprising, in combination, first and second rigid elongated configurated frame elements having a rigid metal core and a synthetic plastic coating surrounding said core, said elements being a mirror image of each other and each including a horizontally disposed lower end section adjacent a horizontally disposed support section transversely oriented to the adjacent end section, a column section vertically extending from said support section having a length at least as great as the mattress thickness, a mattress overlay section extending from said column section and an upper end section transversely depending from said overlay section, said lower and upper end sections of said first and second elements, respectively, extending toward each other and in longitudinal alignment with each other, a pair of elongated synthetic plas-tube connectors having open ends, said aligned lower and upper end sections being slidably received within opposite ends of a connector permitting longitudinal adjustment therein, and friction producing means interposed between said connectors and the end sections received therein comprising depressions defined in said tube connectors displacing tube material inwardly of the tube bore for engagement with said frame element's plastic coating.

* * * * *